United States Patent [19]

Bellamy et al.

[11] Patent Number: 4,747,783

[45] Date of Patent: May 31, 1988

[54] RESISTIVE PIN FOR PRINTED CIRCUIT CARD CONNECTOR

[75] Inventors: Paul D. Bellamy, Poughkeepsie; Richard A. Fritz, Red Hook; Wayne V. Myers, Saugerties; Gary J. Robinson, Poughkeepsie; Raymond L. Simonetty, West Hurley; Jordan M. Taylor, Poughkeepsie, all of N.Y.

[73] Assignee: International Business Machines Corporation, Armonk, N.Y.

[21] Appl. No.: 923,940

[22] Filed: Oct. 28, 1986

[51] Int. Cl.[4] ..... H01R 9/09

[52] U.S. Cl. ..... 439/59; 200/268; 439/181; 439/886

[58] Field of Search ..... 339/111, 278 C, 278 D, 339/17 T, 17 L; 338/308, 331; 361/2, 10, 11, 14, 220, 222; 200/263, 267, 268, 269, 144 R, 151; 439/59, 181, 886

[56] References Cited

U.S. PATENT DOCUMENTS

| | | | |
|---|---|---|---|
| 1,770,839 | 7/1930 | Carpenter | 200/267 |
| 2,716,737 | 8/1955 | Maberry | 339/111 |
| 3,277,424 | 10/1966 | Nelson | 339/111 |
| 4,002,396 | 1/1977 | Murdock | 339/111 |
| 4,117,291 | 9/1978 | Gebauer | 200/269 |
| 4,510,553 | 4/1985 | Faulterstack | 339/17 LC |

*Primary Examiner*—Neil Abrams

*Attorney, Agent, or Firm*—Joseph J. Connerton

[57] ABSTRACT

An improved connector assembly includes a resistor coated guide pin to facilitate coupling or decoupling a circuit card to a circuit board. A first embodiment of the pin configuration comprises a single taper pin for eliminating current surges during insertion of the pin into its associated plug. A second embodiment of the pin configuration comprises a dual taper pin having two zones of resistance for also eliminating the spark and associated high frequency noise resulting from pin insertion into or removal from the connector assembly.

8 Claims, 2 Drawing Sheets

RESISTIVE PIN FOR PRINTED CIRCUIT CARD CONNECTOR

FIELD OF THE INVENTION

The invention relates to an improved connector assembly and, more particularly, to a connector assembly adapted for insertion or removal of a connector without disconnecting power from or disrupting operation of the interconnected components.

BACKGROUND OF THE INVENTION

One of the problems associated with connector assemblies, particularly those for attaching circuit cards to circuit boards, relates to the insertion or removal of the circuit cards to or from a circuit board connector respectively without removing power from the system. Such problems include both power and logic circuitry problems such as current surges, arcing transients and high-frequency noise during connect/disconnect of the connector assemblies. It is essential that means be provided whereby individual connector elements can be coupled or uncoupled without interfering with the normal operation of the associated system. This problem of connector coupling or decoupling to or from an active circuit or power source is designated in the art as the "hot plug" problem.

DESCRIPTION OF THE PRIOR ART

One solution of the "hot plug" problem involves logic generation of a ramp-up voltage in a card initiated by a long pin on the card which makes gradual contact with its mating plug before the remaining card pins make contact. The ramp-up voltage slowly charges the card capacitors. This technique, however, requires complex logic and timing circuitry and manual dexterity in inserting the card at the correct speed.

In U.S. Pat. No. 3,590,319, voltage surges which may occur on a high voltage line upon opening or closing of a power switch located at one end of the line connecting the switch to a power source are attenuated by an attenuating resistance assembly which is structurally separate from the power switch itself. This attenuating assembly includes a resistance component in series with the line, a parallel by-pass switch and an overvoltage protective device which may be in the form of a spark-gap.

In U.S. Pat. No. 4,245,270, a circuit card designed for connection to a circuit board includes a soft power switch for reducing the power transient effects of card insertion by gradually coupling the circuit load on the card to the power supply voltage on the board. The card includes logic which causes the circuit load to be gradually decoupled from the power supply upon removal of the card from the board.

U.S. Pat. No. 4,079,440 discloses in FIG. 2 a printed circuit board having at least two connector plugs for power supply, one relatively long (pin 31), the other relatively short (pin 32). The mating connector plugs are connected to each other through an impedance element 36 whereby, during insertion of the board to a power line, the longer connector plug makes initial contact with the power line before the shorter one; during withdrawal of the board from the line, the longer connector plug breaks contact with the line later than the shorter one.

All of the above cited references require addition logic and timing control circuitry to solve the "hot plug" problem. It is, therefore, essential that a means be provided whereby individual connector assemblies can be coupled or uncoupled without bringing the entire system down.

SUMMARY OF THE INVENTION

In accordance with the instant invention, an improved assembly for coupling or decoupling a circuit card to a circuit board connector without removing power from a circuit board includes a plug having at least one long resistive coated pin in the voltage and/or ground legs of the connector. When a circuit card, for example, is inserted into a circuit board connector, the long pins in the board make initial contact and the voltage is applied gradually to the card capacitors through the resistive pin, thus eliminating surge currents to the printed circuit card capacitors. The card capacitors are slowly charged as the pin is inserted, while the low ohmic connection, when the pin is fully inserted, permits complete charging of the capacitors.

While such connectors are suitable for connection of a circuit card to a power soruce, the connector must have a low overall resistance to charge the card over its insertion length to prevent generating excessive noise on the power bus. This pin resistance is not high enough to prevent high frequency noise, both radiated and conducted, from occurring at the moment of initial contact with the pin. High frequency noise, however, adversely effects the operation of any logic circuitry associated with the connector. To resolve this problem, a second embodiment of the invention utilizes a resistive pin with dual resistance tapers. The term taper, as herein employed, relates to the resistance of the connector pin. A single taper pin has one resistance value, a dual taper pin has two resistance values, etc. The higher resistance is used to eliminate high frequency noise, makes initial contact with the socket. The resistance is then ramped quickly to a lower value for a second portion of the pin length and then ramped to substantially zero resistance to effectively charge the card capacitance.

DESCRIPTION OF THE PREFERRED EMBODIMENT

Before a detailed description of the subject invention, the environment and problems associated with "hot plug" connectability will be briefly described. The "hot plug" problem previously described occurs when a plug such as a printed circuit card is inserted into a socket such as a powered or live circuit board. The first problem is a current surge in the card as the board attempts to charge the decoupling capacitors in the circuit card. A second problem is arcing at the individual pin connections, producing a high frequency noise which is widely distributed throughout the system including the signal lines, resulting in errors being introduced into the system.

Figure 1:
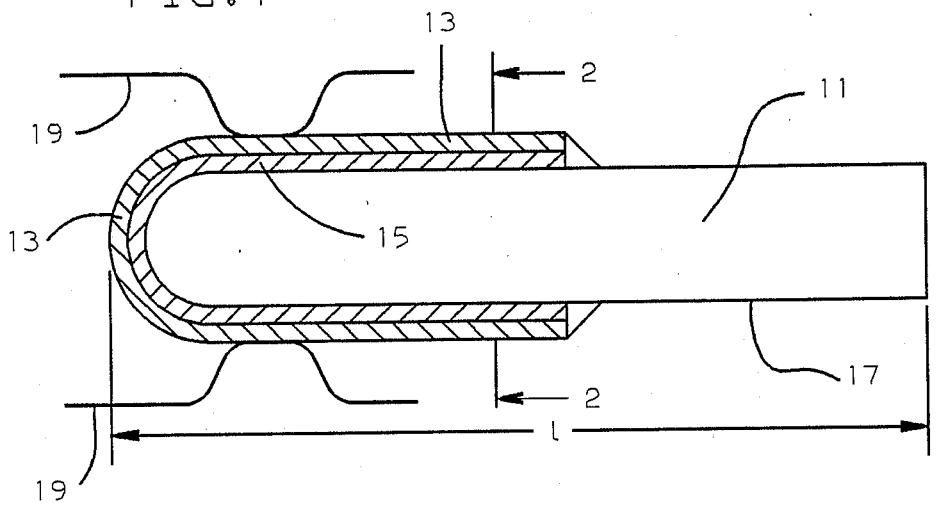
FIG. 1 is a simplified illustration of a single taper resistive contact pin.
Figure 2:
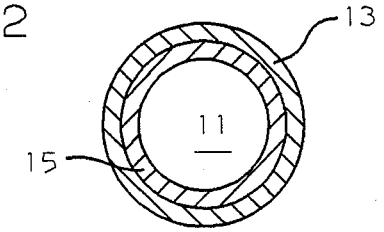
FIG. 2 is a section view taken along the lines 2—2 of FIG. 1.

Referring now to the drawings and more particularly to FIG. 1, thereof, there is illustrated in schematic form a resistive pin constructed in accordance with the instant invention which also functions as a guide pin for the associated card. The resistive pin construction, also shown in the section view of FIG. 2, includes a pin 11 made of conductive material such as copper, precious metal plated copper or in the preferred embodiment, copper-clad invar. An outer layer of resistive material 13 is insulated from the conductive surface of pin 11 by an insulating layer 15, the preferred insulator comprising glass ceramic. The resistive and insulators layers 13 and 15 respectively terminate near the lower resistance end of the pin, permitting the low resistance end of pin 11 to make final contact during plug or pin insertion.

In practice, pin 11 would be used in a circuit board designed for attachment to a circuit card. Since one pin is required for each voltage plane, the simplest configuration such as the preferred embodiment of the invention would require a minimum of two pins for the two voltage planes, although only one of the pins need be resistive. The voltage planes might comprise, for example, a+5 volt and ground plane levels respectively. In practice, these pins are longer than the standard I/O connector pins of the card, and function as guide pins for the circuit card assembly. A resistance pin according to the present invention must have a lower overall resistance to charge the card capacitors over its insertion length without generating excessive low-frequency noise on the associated power bus (not shown).

As previously described, one of the problems associated with "hot plug" technology is current surge as the the power bus attempts to charge the decoupling capacitors across the card planes when a circuit card is inserted into a "hot" circuit board. Since only a low resistance pin is required to prevent current surge, as described above, the resistance of the pin can vary about a nominal value of 2 ohms. Such a resistance layer can be provided by precious metal thick-films, which are commercially available in the art. The preferred embodiment of the invention utilizes thick-film paladium gold for the two ohm coating. The card capacitors are thus slowly charged as the pin is inserted, while the low ohmic connection, when the pin is fully inserted, permits complete charging of the capacitors.

A separate function which may be provided by the long resistive guide pin is to degate the logic and turn off the drivers before the remaining connector pins make contact with the circuit board. After the card is seated, the logic can be turned on by means of a conventional I/O pin. In the preferred embodiment of the invention, the length of the resistive guide pin is between 1 and 1½ inches versus a conventional connector pin length of 0.2 to 0.3 inches. The diameter of the resistive pin is not critical and may or may not correspond to the diameter of the I/O pins. While the low ohmic resistance of the illustrated embodiment functions to limit the current surge during connection of the card to the board, it does not address the problem of high frequency noise radiated throughout the card and board resulting from arcing of the pin during insertion. It was determined that a range of resistance between 60 and 100 ohms would be required to eliminate this condition. However, such resistance values would be too high to permit properly charging the card capacitors and would not solve the current surge problem. Accoringly, another solution directed to solving both problems was required, and the solution illustrated in FIG. 3 was employed.

Figure 3:
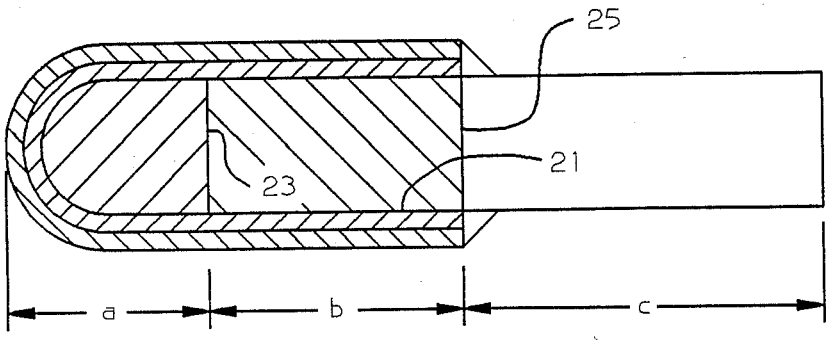
FIG. 3 is a simplified illustration of a dual taper resistive contact pin.

Referring now to FIG. 3, there is illustrated therein a dual taper resistive power pin for precharging cards as they are being plugged into a powered board as well as solving the high frequency noise problem. The pin illustrated in FIG. 3 comprises a high resistance initial contact area, shown as area a in FIG. 3, to eliminate the high frequency noise. The resistance of area a, while not critical, is a nominal 60 ohms. As the pin is inserted to point 23, the resistance of the card ramps to a much lower resistance value, again a nominal 2 ohms, at which value the decoupling capacitors can be charged, preventing current surge. At point 25, the resistance for the remainder of the pin is substantially zero ohms. This construction combines the elimination of high frequency noise while simultaneously providing a low resitance to permit charging of the cards. Again, as in the single taper resistive pin, the low resistance permits charging of the decoupling capacitors, while the higher resistance eliminates the contact spark with its resultant high frequency noise. The 60 ohm resistance value illustrated as area a may comprise a coating of ruthenium oxide, while the 2 ohm resistance comprises a coating of paladium gold as heretofore described. Area c comprises a copper clad invar coating for minimum resistance value.

In operation, as the pin is inserted into and slides along its mating connector 19, the pin resistance changes from maximum (60 ohms) through 2 ohms to zero (or a few milliohms), charging the card capacitors gradually and completely before the normal power pins make contact. the female portion of the connector plug is of conventional construction and the details thereof have been omitted as the interest of clarity. Thus, "hot plugging" is accomplished completely transparent to the user, and without disturbing other circuitry which is in operation at the time.

Figure 4:
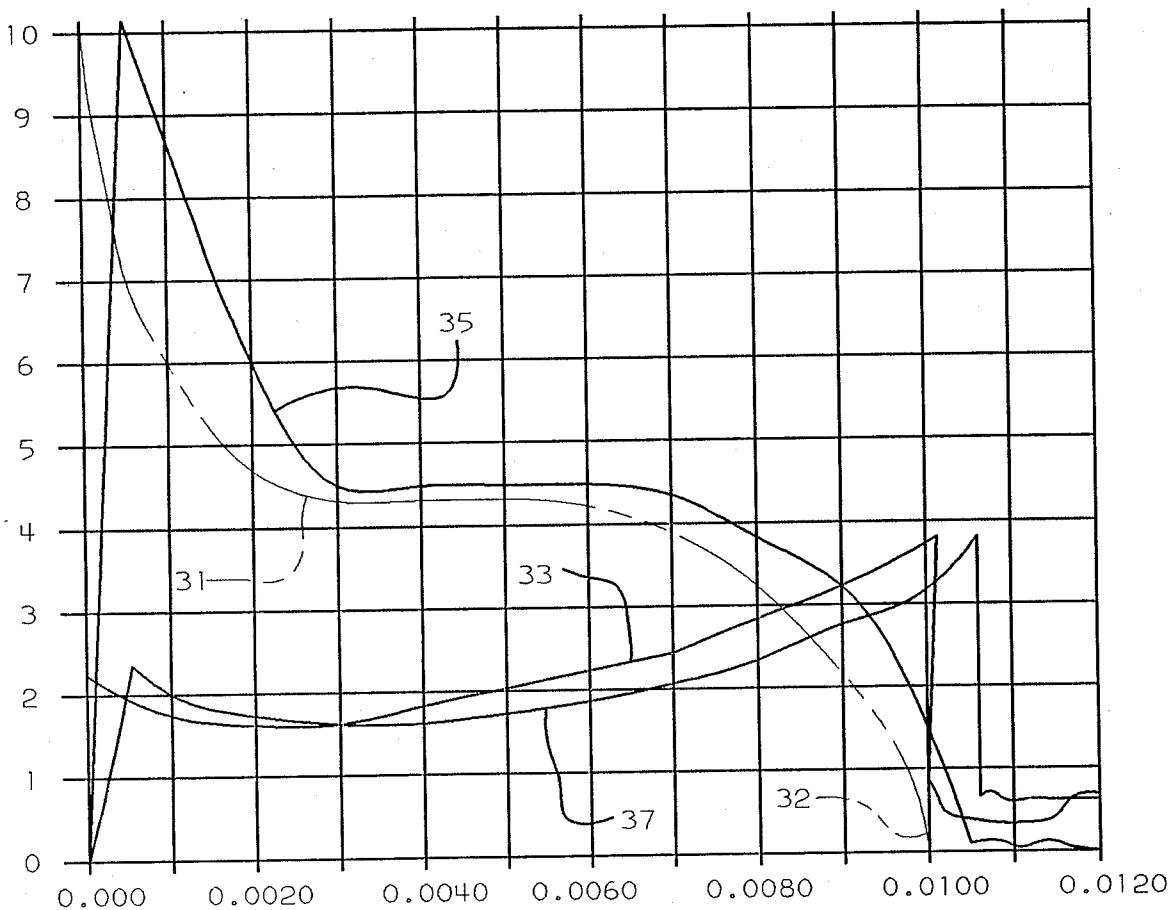
FIG. 4 is a graph of time vs. current and power for the embodiments of FIGS. 1 and 3.

Referring briefly to FIG. 4, a family of curves of time versus power and current are shown for the single and dual taper embodiments of the instant invention. Power and current coordinates are shown in terms of watts and amperes respectively, while the time coordinate is shown in terms of seconds. Curve 31 illustrates the power consumption of the single resistance pin as it varies from two ohms to zero. At zero resistance, illustrated at point 32, the pin is fully inserted within the connector. The maximum power occurs upon insertion, drops fairly rapidly to about 50% maximum and than trails exponentially to zero at point 32. Curve 33 illustrates the current characteristic of the single taper resistive pin. As expected, the variation is slight during insertion until 0.01 seconds, the assumed time required for full insertion and zero resistance, are in effect, at which time the current falls to zero due to current supplied by the normal power pins. Curve 35 shows the power characteristic of the dual taper pin, which rises to a maximum value during the initial insertion as the resistance approaches the 2 ohm area 23, then drops to zero substantially as curve 31 from which its is slightly displaced by the initial insertion time. Curve 37 shows the current charging characteristics of the dual taper pin which are again similar to those of curve 33 after the initial charging period but displaced from curve 33 by the initial charging period.

The instant invention is adapted for use in conventional connector block assemblies or in zero insertion force (ZIF) connector blocks. The invention is equally adapted for high or low density circuit boards and printed circuit cards.

While the preferred embodiment of the invention has been illustrated and described as comprised of a dual taper resistive pin, it is obvious that various combinations of more than two resistance values or a logarithmic taper pin may be preferred for specific applications, and it will be understood by those skilled in the art as encompassed within the scope of the invention.

What is claimed is:

1. A connector system for connecting or disconnecting a connector plug assembly while maintaining continuous operation of load devices associated with said connector system comprising, in combination, a socket, a plug having pins associated with the voltage and/or ground connections of a said load device and adapted for insertion or withdrawal into or from said socket, said pins of said plug being metallic and at least one of said pins having a resistive coating covering a portion thereof, the low resistance of said resistive coating preventing surge currents resulting from insertion or removal of said plug into or from said socket during operation of said system, whereby, upon plug insertion, said socket initially engages the resistive coating of said plug permitting limited current flow through said resistive coating to gradually charge components of the system and upon full insertion of said plug said socket extends past said resistive coating to engage a zone of said plug having a lower or nominal zero resistance.

2. A device of the character claimed in claim 1 wherein said connector plug comprises a circuit board and said socket comprises a circuit card adapted for connection to said circuit board.

3. A device of the character claimed in claim 2 wherein said resistive coated pins are associated with said circuit board.

4. A device of the character claimed in claim 2 wherein the connector socket associated with said resistive coated pin is located on said circuit card.

5. A device of the character claimed in claim 1 wherein the resistive coating of said pins comprises a multi-tapered configuration including a plurality of zones of different resistance values.

6. A device of the character claimed in claim 5 wherein said multi-tapered configuration is a two-zone resistance configuration.

7. A device of the character claimed in claim 6, wherein the higher of said two resistance zones is located at the point of said pin and adapted to eliminate arcing during insertion in of removal from its associated socket.

8. A device of the character claimed in claim 7, wherein the resistance of said contact upon full insertion of said pin is a nominal zero.

* * * * *